United States Patent [19]

Muth

[11] Patent Number: 5,013,101

[45] Date of Patent: May 7, 1991

[54] ANTI-TIP APPARATUS FOR MOBILE STORAGE UNITS

[75] Inventor: James C. Muth, Eagle, Wis.

[73] Assignee: Spacesaver Corporation, Fort Atkinson, Wis.

[21] Appl. No.: 491,836

[22] Filed: Mar. 12, 1990

[51] Int. Cl.[5] ..... A47B 21/00

[52] U.S. Cl. ..... 312/201

[58] Field of Search ..... 312/250, 201, 346; 403/405.1, 408.1

[56] References Cited

U.S. PATENT DOCUMENTS

| | | | |
|---|---|---|---|
| 4,618,191 | 10/1986 | Peterman . | |
| 4,708,411 | 11/1987 | Peterman . | |
| 4,770,475 | 9/1988 | Peterman . | |
| 4,789,210 | 12/1988 | Weiss et al. | 312/346 X |
| 4,904,110 | 2/1990 | Klein | 403/408 X |
| 4,911,507 | 3/1990 | Leist | 312/201 |

*Primary Examiner*—Joseph Falk

*Attorney, Agent, or Firm*—Fuller, Ryan & Hohenfeldt

[57] ABSTRACT

An anti-tip mechanism for a mobile storage system. The system includes movable carriages, each having a pair of wheels journaled to the carriage frame, and adapted to be moved along tracks on a building floor. The anti-tip mechanism includes a pair of catch rails adjacent to and co-extensive with the tracks. Each catch rail includes an upper horizontal portion projecting toward the track, supported by an upright support member. Two hook plates are spaced apart and attached to the carriage frame for each of the catch rails. Each hook plate has a lower leg projecting beneath the top horizontal portion of the respective catch rail. The attachment of each hook plate to the carriage frame is via an L-tab, which has an insert portion inserted into a slot in the hook plate and a slot in the carriage frame, and an overlay portion overlying the hook plate. The overlay portion is attached to the carriage frame over the hook plate by any suitable removable attachment, such as a threaded fastener.

11 Claims, 2 Drawing Sheets

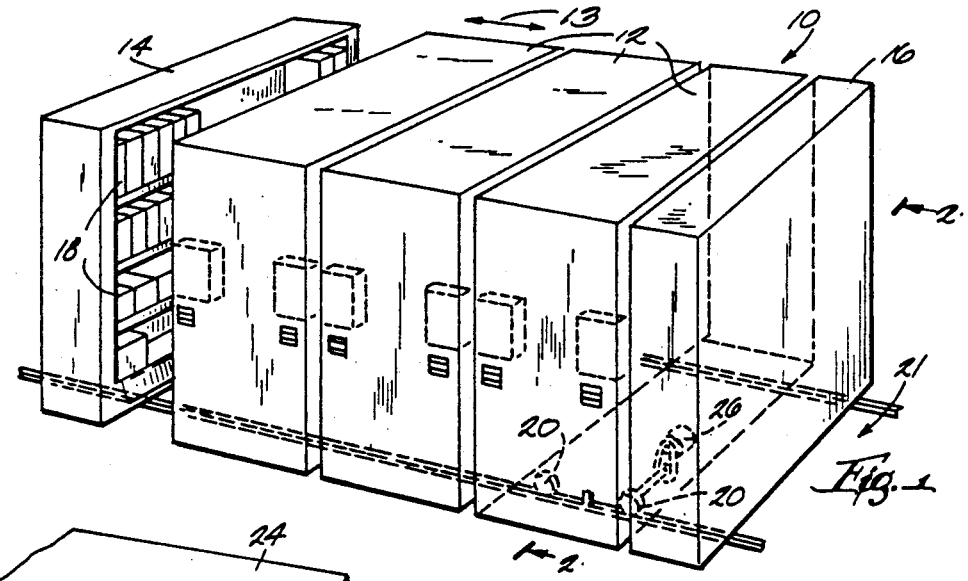
Fig. 1
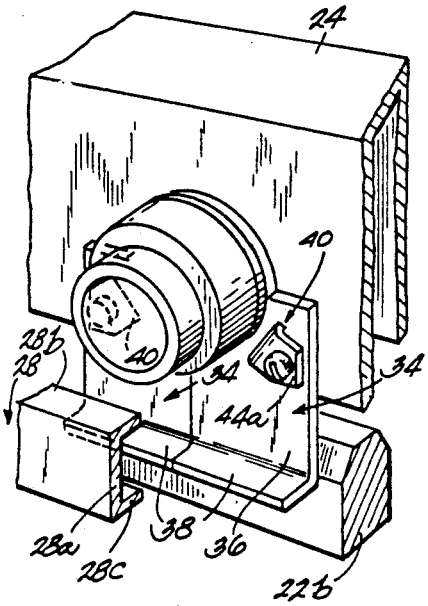
Fig. 3
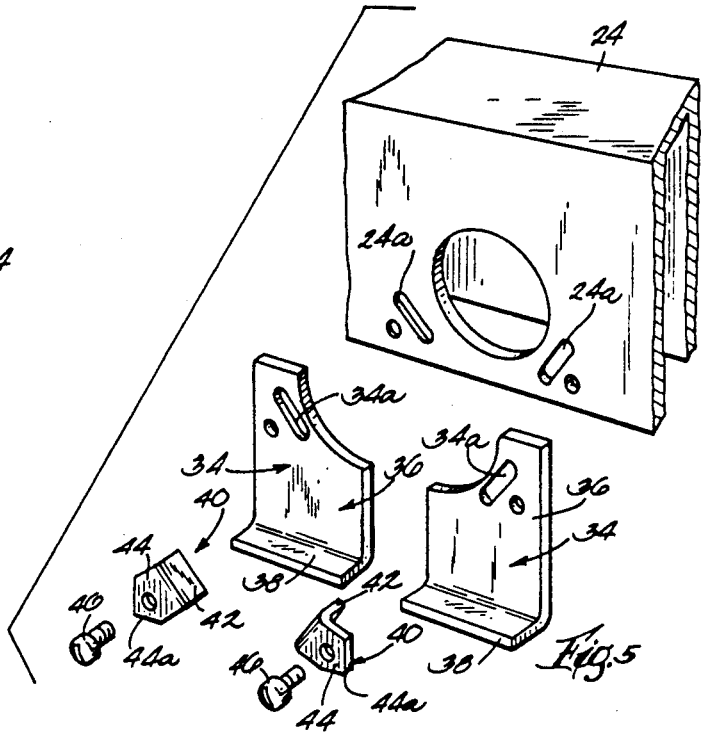
Fig. 5
Fig. 2
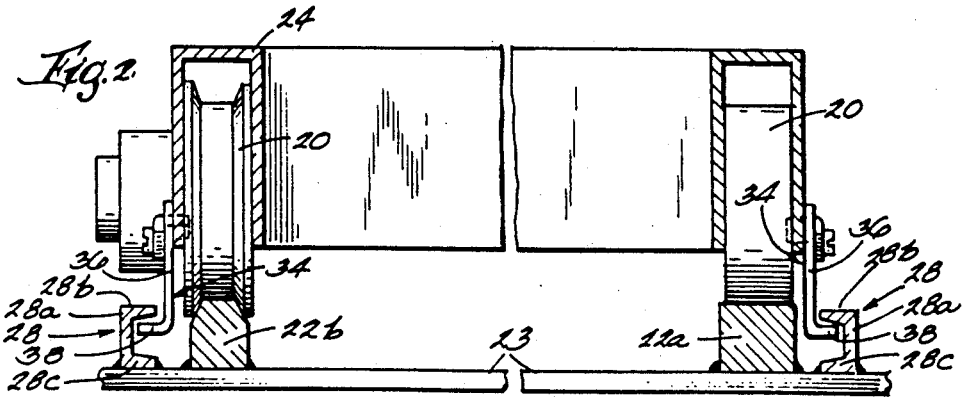

ANTI-TIP APPARATUS FOR MOBILE STORAGE UNITS

BACKGROUND OF THE INVENTION

This invention relates to mobile storage units and in particular to apparatus for application to these storage units, most particularly apparatus for preventing these storage units from tipping in the fore and aft direction of movement.

Mobile storage systems comprise a series of storage units which have shelves or bins, for example. Each of the storage units is movable on rails to create an access aisle between two of the units and to establish the others in close side-by-side relationship to minimize the amount of floor space required for the units. Especially in larger mobile storage units and systems, the carriages can be quite large, and the loads they carry quite heavy, such as steel or construction materials. One characteristic of these units is that each unit is relatively high and narrow in the direction of travel along the rails. A top loaded unit may thus become unstable and capable of tipping in the direction of motion, either at the beginning of movement or at the end.

There are anti-tip devices that are known to be usable in connection with these mobile storage units. For instance, Peterman, U.S. Pat. No. 4,618,191, discloses a locking arm that is pivotably attached to the underside of the carriage frame and latches onto the underside of a specially designed rail. While such a device has been generally satisfactory, there may be certain operating conditions under which it may be possible for the storage unit to lurch to one side of the rails.

Another anti-tip device for application to a mobile storage unit is shown in Peterman, U.S. Pat. No. 4,708,411. While this device has been widely used, in certain applications it may be advantageous to provide an anti-tip device with greater shear strength or which provides more leverage to counter the likelihood of the storage unit to tip.

This invention relates to improvements to the structure indicated above and to solutions to the problems raised or not solved thereby.

SUMMARY OF THE INVENTION

The invention includes a mobile storage system having at least one movable carriage. The storage system includes a pair of wheels journaled to the carriage. The wheels are adapted to engage and move along each of at least two parallel tracks on a building floor. According to the invention, the system includes an anti-tip mechanism, which in turn includes a pair of catch rails, each catch rail positioned adjacent to and substantially coextensive with a respective one of the tracks. Each catch rail is formed of a substantially upright support portion and a generally horizontal portion positioned at the top of the upright support portion and projecting toward the respective track at a level somewhat above the floor. Each catch rail may also include a second generally horizontal portion attached to or integrally formed with the bottom of the upright support portion, for supporting the catch rail and holding the upright portion generally vertical, and for facilitating the attachment of the catch rail to the floor. In this configuration the catch rail forms a channel lying on its side, with top and bottom horizontal portions connected together and spaced apart by the upright support portion. The catch rails may be positioned between the tracks or outside of them. A pair of hook plates for each of the catch rails is attached to the carriage frame of the storage unit. The hook plates may be spaced apart a desired distance in their attachment to the frame so as to provide additional leverage and anti-tip power. Each of the hook plates has a lower leg projecting beneath the horizontal portion of the respective catch rail. The attachment of each of the hook plates to the carriage frame is by means of an L-tab, each L-tab having an insert portion which is inserted into a slot in the respective hook plate and a slot in the carriage frame, and an overlay portion which overlies the hook plate, generally at right angles to the insert portion. The overlay portion is attached to the carriage by a threaded fastener that passes through the overlay portion and is threaded into the carriage frame. The insert portion, the width of which is substantially the entire width of the L-tab, provides significantly more strength in resisting shear forces than if the hook plate were attached to the carriage frame by a threaded fastener alone.

Other objects and advantages of the invention will become apparent hereinafter.

DESCRIPTION OF THE DRAWING

FIG. 1 is an isometric view of a mobile storage system employing an anti-tip apparatus according to a preferred embodiment of the invention.

FIG. 2 is a cross sectional view of the carriage portion of the mobile storage system shown in FIG. 1, taken a long line 2—2 thereof.

FIG. 3 is an isometric view, on an enlarged scale, of an anti-tip apparatus constructed according to one embodiment of the invention.

FIG. 5 is an exploded isometric view of a portion of the anti-tip apparatus shown and described in the present application.

DESCRIPTION OF THE PREFERRED EMBODIMENT

Figure 6:
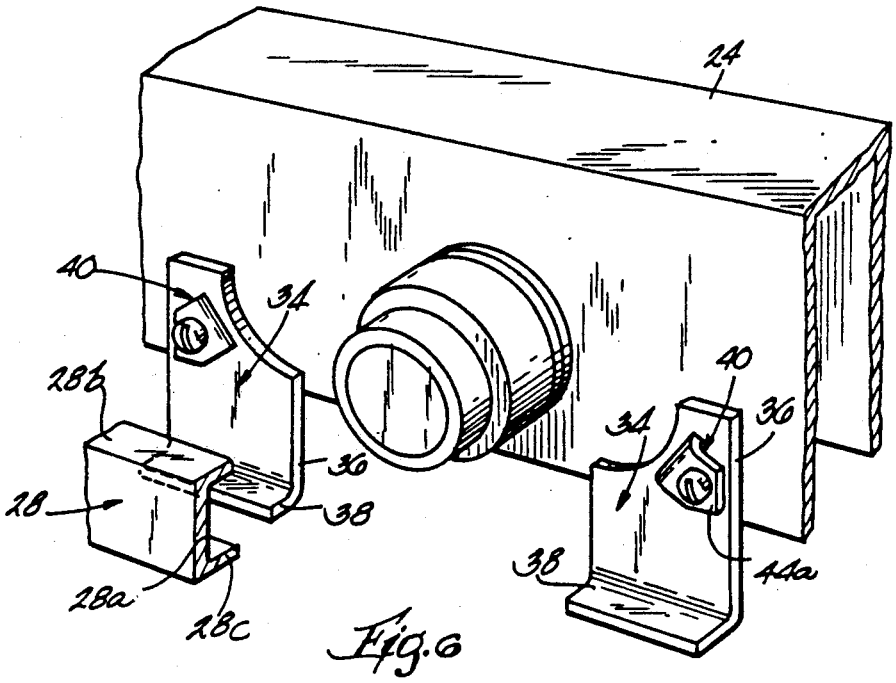
FIG. 6 is an isometric view, on an enlarged scale, of an anti-tip apparatus constructed according to an alternative embodiment of the invention.

Referring now to FIG. 1, there is shown a storage system 10 including several mobile storage units 12 arranged to move alternately and selectively to the left and right as depicted at 13 to establish an access aisle between them as needed by a user. In some installations there may be a dozen or more of such units 12. The mobile storage units 12 customarily move between a pair of stationary end storage units 14 and 16. As is well known, the storage units are commonly used to store various different items 18, such hardware, books and files for example. As is also well known, each mobile storage unit 12 usually has four wheels 20 which run on tracks 22. These tracks 22 are often recessed in slots in a floor of the room in which the storage units are installed, or a modular floor may be built up above the existing floor 21 (FIG. 1) so as to recess the tracks. The tracks 22 are often connected together by a floor frame 23 (FIG. 2). As shown in FIG. 2, one of these tracks **22*a* is usually flat while the other 22*b*** is usually beveled to permit use of flanged wheels thereon, for keeping the carriage aligned with and on the tracks.

As can be seen in FIG. 1, these storage units 12 are generally high and narrow in the direction of movement 13. Without provision to the contrary, a unit 12 either beginning its movement to open an aisle or ending its movement to close an aisle could be subject to tipping forces. The present invention is directed to preventing such tipping.

According to the invention, each mobile storage unit 12 has a carriage frame 24 (FIGS. 2 through 6), having generally four wheels 20 journaled thereto, as indicated above, at least one of which is a driven wheel, driven by any suitable prime mover 26 (FIG. 1). A pair of catch rails 28 are positioned adjacent to and substantially coextensive with the tracks, one catch rail for each track. Each catch rail 28 is formed of a substantially upright support portion 28*a* and a generally horizontal top portion 28*b* positioned at the top of the upright support portion and projecting toward the respective track 22.

For additional stability, each catch rail 28 may also include a second generally horizontal lower support portion 28*c* positioned at the bottom of the upright support portion 28*a*, for supporting the catch rail and holding the upright portion generally vertical. When the catch rail 28 includes this lower support portion 28*c*, the cross section of the catch rail may be that of a channel, lying on its side, with the lower support portion 28*c* and the top portion 28*b* both generally horizontal and parallel to each other, and spaced apart by the upright support portion 28*a*.

Figure 4:
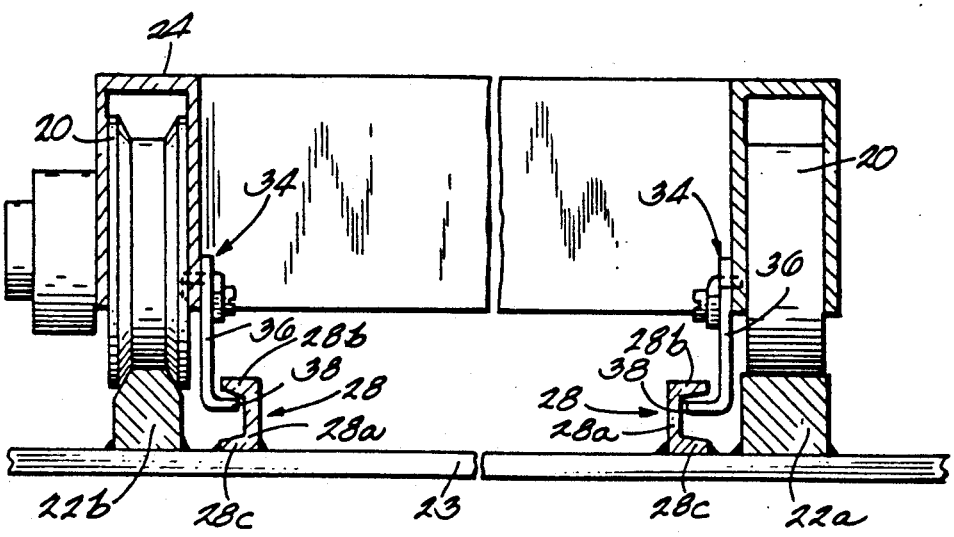
FIG. 4 is a cross sectional view of the carriage portion of mobile storage system shown in FIG. 1, showing an anti-tip apparatus constructed according to an alternative embodiment of the present invention.

The catch rails 28 may be affixed in any suitably secure manner adjacent to and substantially coextensive with the tracks 22. In the embodiment shown in FIG. 2, each of the catch rails 28 is positioned outside the tracks 22 and positioned with respect to the respective track by attachment to the floor frame 23, which also runs under tracks 22. This attachment is made by any suitably secure means, such as fill-welding holes (not shown) provided for that purpose in the lower support portion 28*c*. Alternatively, as shown in FIG. 4, the catch rails 28 may be positioned between the tracks 22, and again positioned with respect to the tracks 22 by similar attachment to floor frame 23.

According to the invention, a pair of hook plates 34 is provided for each one of the catch rails 28. Each of the hook plates 34 has a body 36 by which it is attached to the carriage frame 24, and an integrally formed lower leg 38 projecting transversely from the body, outward from the carriage frame, and extending beneath the upper horizontal portion 28*b* of the respective catch rail 28. The hook plates 34 are provided in pairs so that they can be mounted to the carriage frame 24 together, as shown in FIG. 3, or spaced apart in their attachment to the carriage frame, as shown in FIG. 6, thus providing improved leverage and anti-tip power over prior art anti-tip apparatus.

As shown in FIGS. 3 and 6, each of the hook plates 34 is attached to the carriage frame 24 by means of an L-tab 40, shown best in the exploded isometric view of FIG. 5. Each L-tab 40 has an insert portion 42 which is inserted into a slot 34*a* in the respective hook plate 34 and a slot 24*a* in the carriage frame 24, and an integrally formed overlay portion 44 which is formed at generally a right angle to the insert portion and overlies the hook plate. The L-tab 40 is fastened in this position, and the hook plate 34 fastened to the carriage frame 24, by any suitable means. In the embodiment shown in the drawing figures, a threaded fastener 46 is provided, passing through the hook plate and threaded into the carriage frame 24 for improved integrity. As can be seen in FIGS. 2 and 5, the overlay portion 44 shown there is pointed in shape, with the point 44*a* oriented away from the insert portion 42. The advantage of this point 44*a* is to permit the placement of the threaded fastener 46 further away from the insert portion 42, and at the same time permitting its placement nearer the edge of the hook plate 34.

The insert portion 42, being substantially the entire width of the L-tab 40, provides significantly more strength in resisting the shear forces exerted on it by the carriage frame 24 and the hook plate 34 than if the hook plate were attached to the carriage frame by the threaded fastener 46 alone.

While the apparatus hereinbefore described is effectively adapted to fulfill the aforesaid objects, it is to be understood that the invention is not intended to be limited to the specific preferred embodiment of anti-tip apparatus for mobile storage units set forth above. Rather, it is to be taken as including all reasonable equivalents within the scope of the following claims.

I claim:

1. In a mobile storage system having at least one movable carriage including a pair of wheels journaled to said carriage and adapted to engage and move along each of at least two parallel tracks on a building floor, an anti-tip mechanism comprising:

a pair of catch rails, each catch rail positioned adjacent to and substantially coextensive with a respective one of said tracks, and each catch rail being formed of a substantially upright support portion and a generally horizontal portion positioned at the top of said upright support portion and projecting toward said respective track;

a pair of hook plates for each of said catch rails, each of said hook plates having a lower leg projecting beneath said horizontal portion of said respective catch rail;

each of said hook plates attached to said carriage by means of an L-tab, each L-tab having an insert portion which is inserted into a slot in the respective hook plate and a slot in the carriage, and an overlay portion which overlies the hook plate and is attached to said carriage by a threaded fastener which passes through the overlay portion and into the hook plate, and at least into the carriage, said insert portion thus providing added resistance to shear of the threaded fastener.

2. A mobile storage system as recited in claim 1 wherein said L-tab insert portion and said L-tab overlay portion are at right angles to each other.

3. A mobile storage system as recited in claim 1 wherein said individual hook plates of each respective pair are spaced apart from each other on said carriage.

4. A mobile storage system as recited in claim 1 wherein each said catch rail further comprises a second generally horizontal portion positioned at the bottom of said upright support portion, for supporting said catch rail and holding said upright portion generally vertical.

5. A mobile storage system as recited in claim 4 wherein each said catch rail is positioned outside the tracks and positioned with respect to the respective track by attachment to a floor frame member extending beneath the track and the second horizontal portion of said catch rail.

6. A mobile storage system as recited in claim 4 wherein both said catch rails are positioned between the tracks and positioned with respect to each other and said tracks by attachment to a floor frame member extending beneath said catch rails and tracks.

7. A carriage for a mobile storage system adapted to engage and move along each of at least two parallel tracks on a building floor, and a pair of catch rails, each catch rail positioned adjacent to and substantially coextensive with a respective one of said tracks, and each catch rail being formed of a substantially upright support portion and a generally horizontal portion positioned at the top of said upright support portion and projecting toward said respective track, said carriage comprising:

a frame;

a pair of wheels for each of said tracks, each of said wheels journaled to said frame and having a shape adapted to ride on said respective track;

a pair of hook plates for each of said catch rails, each of said hook plates having a lower leg projecting beneath said horizontal portion of said respective catch rail;

each of said hook plates attached to said frame by means of an L-tab, each L-tab having an insert portion which is inserted into a slot in the respective hook plate and a slot in the frame, and an overlay portion which is attached to said hook plate by a threaded fastener which passes through the overlay portion and into the hook plate, and at least into the carriage, said insert portion thus providing added resistance to shear of the threaded fastener.

8. A carriage for a mobile storage system as recited in claim 7 wherein said L-tab insert portion and said L-tab overlay portion are at right angles to each other.

9. A carriage for a mobile storage system as recited in claim 7 wherein said individual hook plates of each respective pair are spaced apart from each other on said frame.

10. A mobile storage system as recited in claim 1 wherein said L-tab insert portion has a dimension, transverse to the direction of insertion in the slots, which is substantially greater than the diameter of the threaded fastener.

11. A mobile storage system as recited in claim 7 wherein said L-tab insert portion has a dimension, transverse to the direction of insertion in the slots, which is substantially greater than the diameter of the threaded fastener.

* * * * *